United States Patent [19]

Ohnishi

[11] 3,932,877

[45] Jan. 13, 1976

[54] ELECTROPHOTOGRAPHIC RECORDING SYSTEM WITH PLATE CLEANING

[75] Inventor: Masaru Ohnishi, Amagasaki, Japan

[73] Assignee: Mitsubishi Denki Kabushiki Kaisha, Tokyo, Japan

[22] Filed: July 2, 1974

[21] Appl. No.: 485,079

[30] Foreign Application Priority Data

July 4, 1973 Japan ..... 48-75485

[52] U.S. Cl. ..... 346/74 P; 15/1.5; 317/2 F; 355/3 R

[51] Int. Cl.[2] ..... G03G 15/16; H05F 3/06

[58] Field of Search ..... 346/74 ES, 74 P, 74 EB, 346/73 IB; 355/3 R; 317/2 F; 354/3; 15/1.5

[56] References Cited

UNITED STATES PATENTS

| | | | |
|---|---|---|---|
| 3,457,070 | 7/1969 | Watanabe | 346/74 P |
| 3,668,008 | 6/1972 | Severynse | 15/1.5 |
| 3,673,598 | 6/1972 | Simm | 346/74 IB |
| 3,743,540 | 7/1973 | Hudson | 15/1.5 |
| 3,747,119 | 7/1973 | Matkan | 346/74 P |
| 3,776,627 | 12/1973 | Ohnishi | 346/74 P |

*Primary Examiner*—Bernard Konick
*Assistant Examiner*—Jay P. Lucas
*Attorney, Agent, or Firm*—Oblon, Fisher, Spivak, McClelland & Maier

[57] ABSTRACT

An electrophotographic recording method comprising the steps of forming a charge image of specific polarity on an electrophotographically sensitive plate, transferring the charge image to a recording paper, and neutralizing the residual charge on the electrophotographically sensitive plate by the use of shielding type charge erasers capable of shielding the electric field of corona discharge and having an ion transmissive property.

9 Claims, 12 Drawing Figures

ELECTROPHOTOGRAPHIC RECORDING SYSTEM WITH PLATE CLEANING

BACKGROUND OF THE INVENTION

1. Field of the Invention

The present invention relates to an electrophotographic recording system using an electrophotographically sensitive plate, and more particularly, to an electrophotographic recording system capable of erasing the residual charge on the electrophotographically sensitive plate by the use of an ionic erasing method.

2. Description of the Prior Art

Marked development has been achieved of late in the art of electrophotographic recording systems by virtue of various improvements proposed in electrophotography.

One well known electrophotographic recording system uses an electrophotographically sensitive plate consisting at least of three layers; a front insulating layer, a photoconductive sensitive layer, and a rear electroconductive layer, wherein a charge image of specific polarity is formed on the front insulating layer, the charge image is transferred to a recording paper by means of a transferring roller, and the residual charge on the front insulating layer is erased by a suitable method such as cleaning, charge-erasing, or corona charging at reverse polarity.

This conventional recording system will be described in detail by referring to FIGS. 1 and 2.

FIGS. 1*a* through 1*d* schematically illustrate steps of the electrophotographic process. In FIG. 1*a*, the reference numeral 4 denotes an electrophotographically sensitive plate (hereinafter referred to as a photosensitive plate) constituted integrally of a front insulating layer 1 such as a Mylar film, a photoconductive layer 2 comprised of CdS, Se-Te or the like with a lowered impedance when exposed to light and a rear surface electrode 3.

The step of forming a charge image on the photosensitive plate 4 by a negative corona charging device 5 will be described. For explanatory simplicity, assume that the photosensitive plate 4 is exposed not in the left half but in the right as shown in FIG. 1*a*.

The impedance of the photoconductive sensitive layer 2 is lowered in the exposed part with the result that the quantity of charge imparted from the coronoa charging device 5 to the front insulating layer 1 increases to cause the surface of the insulating layer to be strongly charged at a negative polarity. In the unexposed part, the impedance of the photoconductive sensitive layer 2 is high. Accordingly, the front insulating layer 1 is weakly charged as shown in FIG. 1*b*.

With reference to FIG. 2*a*, the solid line indicates the relationship between the potential at the front insulating layer and the illuminance in the photosensitive plate 4 with CdS layer 2. In FIG. 2*a*, the abscissa represents the dose of light (lux-sec), that is, the product of the illuminance (lux) and the time of exposure (sec). The ordinate represents the potential $V_1$ (volts) at the front insulating layer 1. FIG. 2*a* indicates that the potential approaches a constant value $Ve$ as the dose of light increases, approaches a value $Vd$ as the dose of light decreases, and assumes a value according to illuminance in the intermediate range of light dose.

The dependence of the dose of light upon the potential is heavily dependent on the material of the photoconductive sensitive layer 2, as well as on the method of making it, and is not inherent in CdS. Assume that the photosensitive plate 4 is constituted of a front insulating layer 1 of Mylar 15 microns thick, and a photoconductive sensitive layer 2100 microns thick formed of CdS powder containing an impurity (0.005 wt.% copper) with a binder (10 wt.% acryl resin). Experimentally, this photosensitive plate was charged by use of a charger 5 in such manner that the charger was moved above the photosensitive plate at a speed of 300 mm/sec as a corona charge of −6.0 kV with an effective width of 30 mm was being applied by a tungsten wire of 50 microns in diameter with the result that the potentials $Ve$ and $Vd$ were −1300 V and −600 V, respectively.

Then, as shown in FIG. 1*c*, an electrostatic recording paper 8 comprising a low resistance paper 7 on which a high resistance layer 6 is attached is brought into contact with the front insulating layer 1 of the photosensitive plate 4 by a transferring roller 9 connected to a voltage source 10 offering a transferring voltage $Vb_1$ whereby the charge on the front insulating layer 1 is transferred to the surface of high resistance layer 6 of the electrostatic recording paper.

Assume that the transferring roller 9 is grounded directly. Then, the transferring is effected only when the potential at the front insulating layer 1 exceeds the transferring initiation voltage $Vo_1$ which is developed due to the discharge or an electric field across a narrow gap between the photosensitive plate 4 and the electrostatic recording paper 8 because the charge on the front insulating layer 1 is transferred to the recording paper across this gap.

The transferring initiation voltage $Vo_1$ depends upon the condition of the surface of the recording paper 8 and of the front insulating layer 1 and usually ranges from ±300 to +500 V. After the charge is transferred, a potential of about $Vo_1 + \alpha (V_1 - Vo_1)$ is considered to remain on the front insulating layer. (Note: The symbol $\alpha$ stands for a value which depends upon the capacitance of the front insulating layer 1 and the high resistance layer 6; it is normally 0.2 to 0.3) For example, assume $\alpha$ is 0.2. Then, the potential which remains on the layer 1 (or the residual potential on the layer 1) after the charge is transferred is about −520 V since $Vo_1$ is −500 V and $V_1$ is −600 V in the unexposed part of the layer 1 before the charge is transferred. This residual potential becomes −640 V when $V_1$ is −1300 V in the exposed part thereof.

FIGS. 1*d* and 2*b* show how the residual potential changes with a change in the dose of light applied. When the photosensitive plate 4 on which a residual potential of −520 V is present in the unexposed part is negatively charged again as in the process illustrated in FIG. 1*a* with the aim to use such photosensitve plate repeatedly, the charge potential dependent upon the impedance of the photoconductive sensitive layer 2 is superposed on the residual potential. This results in −830 V being negatively larger than −600 V which is the potential in the unexposed part charge from zero potential for the first time.

The potential curve in the second charging is indicated by the broken line in FIG. 2*a* wherein the potential $Ve$ approaches the saturated potential of the charger 5 when the dose of light is large. Hence, the potential after the second negative charging is about −1300 V which is equal to the charged potential for the first time. As a result, the potential in the unexposed part becomes further negative. Because the potential at the front insulating layer 1 in the unexposed part is higher than the transferring initiation potential −500 V even in the first turn of negative charging, the charge transfer to the recording paper 8 occurs also in the unexposed part. This causes a certain amount of toner to be attracted by the unexposed part in the process of development wherein the recording paper is placed in a liquid developer containing dispersed toner. Consequently, low signal-to-noise rato (S/N) recording results. In the second process of negative charging, the S/N becomes lower due to the fact that the potential in the unexposed part is negatively larger than that produced in the first turn.

In the prior art recording systems, wherein negative charging occurs only once, the unexposed part also is negatively charged to cause the recording S/N to be lowered and, in addition, the presence of the transferring initiation potential used in the process of electrostatic recording serves to further lower the S/N. This has hampered the repeated use of the photosensitive plate 4. It is for this reason that repeated recording with a high S/N could have hardly been realized by one charging process on an electrophotographically sensitive plate which comprises a front insulating layer.

One prior art approach to this problem is the adoption of a charge erasing process using an AC corona discharge or a DC charging process at opposite polarity to that of the residual charge.

In the former process, however, the AC corona discharge becomes unbalanced with respect to positive and negative polarities resulting in a certain amount of residual negative charge. In the latter process, it is impossible to maintain constant the potential at the surface of the front insulating layer.

SUMMARY OF THE INVENTION

Therefore, an object of the invention is to provide an improved electrophotographic recording system.

Another object of the invention is to provide an electrophotographic recording system capable of operation with a high S/N.

Still another object of the invention is to provide an electrophotographic record system which permits the initial potential to be accurately set.

A further object of the invention is to provide an electrophotographic recording system capable of perfectly erasing the hysteresis in the repeated use of the photosensitive plate in spite of the employment of the method wherein the photosensitive plate is charged once.

BRIEF DESCRIPTION OF THE DRAWINGS

Other objects, features and advantages of the invention will become more apparent from the following description when taken in conjunction with the accompanying drawings, wherein.

DESCRIPTION OF THE PREFERRED EMBODIMENTS

Figure 1D:
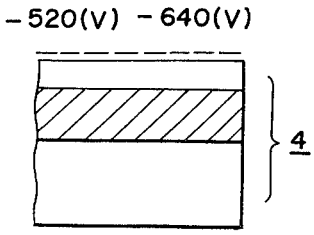
FIG. 1d PRIOR ART

The principles of the system of the invention will first be described below. As previously described by referring to FIG. 1*d*, it is apparent that repeated recording is available when the negative charge which remains after the charge transfer by the transferring roller 9 is erased by a suitable means.

To erase the negative charge, it is necessary to supply positive charge to the photosensitive plate 4.

Figure 1A:
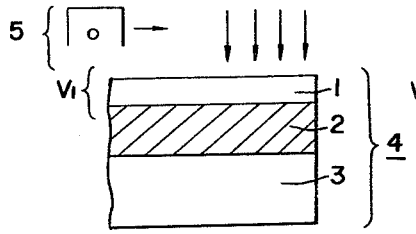
FIG. 1a PRIOR ART
FIGS. 1*a* through 1*d* are schematic diagrams showing the steps of operating a prior art electrophotographic recording system having a charge transfer function.
Figure 2A:
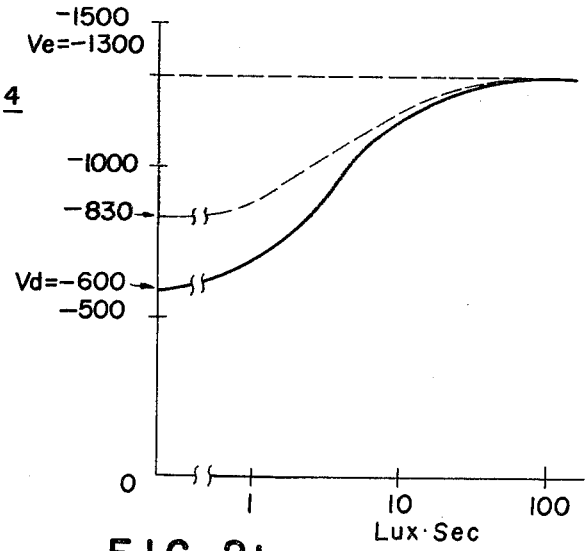
FIG. 2a PRIOR ART
FIG. 2*a* is a diagram showing how the potential at the front insulating layer changes before the step of charge transfer in the prior art electrophotographic recording system
Figure 1B:
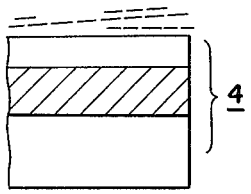
FIG. 1b PRIOR ART
Figure 2B:
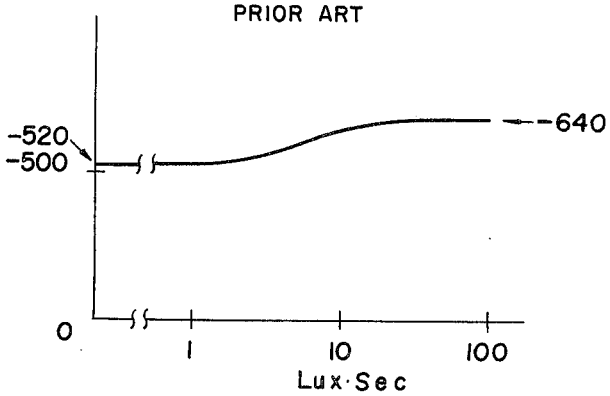
FIG. 2b PRIOR ART
FIG. 2*b* is a diagram showing how the potential at the front insulating layer changes after the step of charge transfer in the prior art system.
Figure 1C:
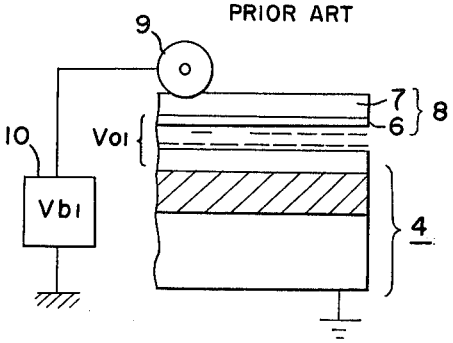
FIG. 1c PRIOR ART
Figure 3:
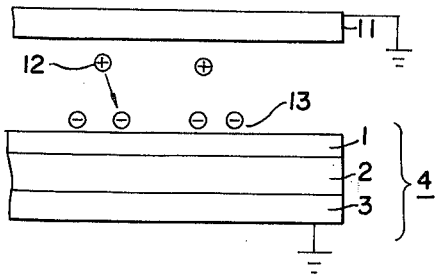
FIG. 3 is a model diagram illustrating the principles of an electrophotographic recording system using an ionic erasing method according to the invention.

One of the more important aspects of the invention lies in its use of a novel positive charge supplying means and charge erasing method. FIG. 3 illustrates by model the principles of the invention. An enlarged view is shown in FIG. 3 for explanatory simplicity wherein a residual charge 13 is present on the electrophotographically sensitive plate 4 after a charge image has been transferred to a sheet of electrostatic recording paper.

In FIG. 3, a grounding electrode 11 is installed opposite to the front insulating layer 1 of the photosensitive plate 4 having its rear electrode 3 grounded. Assume that positive ions 12 are introduced into this system. Then the positive ions move to the side of layer 1 due to coulomb force produced by the potential of the residual charge 13. If a large number of positive ions are present, the positive ions compensate for the residual charge on the photosensitive plate 4 viewed from the front insulating layer until the negative potential becomes zero. Thus, the residual charge can be erased after the lapse of a certain length of time.

This charge erasing time becomes short as the density of positive ions present in the gap between the grounding electrode 11 and the front insulating layer 1 becomes large. For example, the charge erasing time is about several tens to several thousands milliseconds when the gap is 2mm. One noteworthy feature of the principle of the invention is that the residual charge itself serves as a potential source which attracts ions of opposite polarity to that of the residual charge.

It is considered that the bulk of this negative potential source, i.e., the residual charge, is normally of the polarization charge at the front insulating layer 1 and the remainder is of the polarization charge at the photoconductive insulating layer 2 or of the connective internal polarization charge.

In accordance with the invention, the residual charge includes all charges which appear as a negative potential from the side of grounding electrode 11.

For explanatory simplicity, the charge is assumed to be held on the front insulating layer 1. As described above, the principles of the invention are broadly summarized as (i) the grounding electrode 11 is disposed on the side opposite to the front insulating layer 1, and (ii) ions of opposite polarity to that of the residual charge are present in the gap between the grounding electrode 11 and the front insulating layer 1, which ions are attracted by the coulomb force occassioned by the residual charge.

Figure 4:
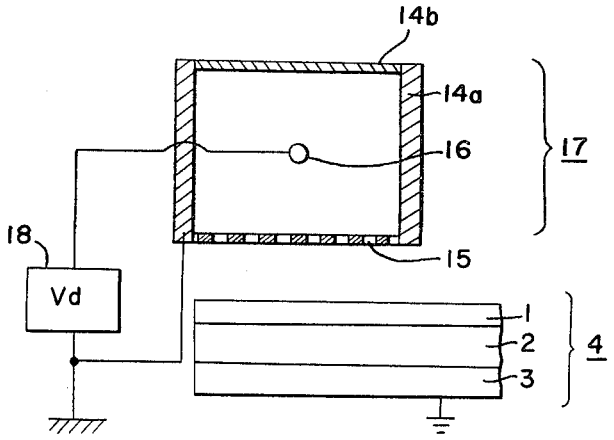
FIG. 4 is a schematic diagram showing an electrophotographic recording system of one embodiment of the invention using a shielding type charge eraser.

A system capable of satisfying these conditions is schematically illustrated in FIG. 4 wherein an AC power source is used as a corona source for producing both positive and negative ions. FIG. 4 shows a sectional view of a shielding type charge eraser 17 which is shielded against corona electric field and which comprises a grounding guard electrode 14*a* and a transparent guard electrode 14*b* constituted of Nesa glass or metal mesh through which light can be introduced thereinto.

The reference numeral 15 denotes a mesh electrode made of copper, stainless steel, nickel or the like, which is installed opposite to the transparent guard electrode 14*b* and below the grounding guard electrode 14*a*. A corona wire 16 is disposed between the mesh electrode 15 and the transparent guard electrode 14*b*. This corona wire is of tungsten wire or gold-plated tungsten wire 50 to 100 microns in diameter.

An electrophotographically sensitive plate 4 (or briefly, photosensitive plate 4) of the type as previously described consists essentially of a front insulating layer 1, a photoconductive sensitive layer 2, and a rear electrode 3. The numeral 18 denotes an AC corona source having one terminal grounded together with the grounding guard electrode 14*a*, and the other terminal connected to the corona wire 16.

In FIG. 4, assume that the residual charge is at negative polarity, and that a corona voltage V*d* is applied to the corona wire 16 from the AC corona source 18. This causes the corona wire 16 to produce a large number of positive and negative ions which are confined inside the charge eraser 17 since the corona electric field around the corona wire 16 is shielded by the guard electrode 14*a*, transparent guard electrode 14*b* and mesh electrode 15.

The mesh electrode 15 must meet the following conditions:

a. The mesh must be so fine that the AC corona voltage Vd can be effectively shielded.

b. The mesh must be so loose that positive ions can be passed therethrough.

There is a range of mesh for practical applications. For example, when the gap between the mesh electrode 15 and the photosensitive plate 4 is 1 to 5 mm, the mesh may range from 10 to 50 in view of corona shielding or from 2000 to 5000 in view of ion transmissivity. Thus, the range of practical meshes was found to be fairly wide.

In this embodiment, an electrode 15 of 50 to 200 mesh may be used in view of ion transmissivity, ability to shield the corona electric field, and ease of manufacture.

By the use of such a mesh electrode, no corona electric field leaks out of the charge eraser 17. When a residual charge is present on the front insulating layer 1 of the photosensitive plate 4, the positive ions generated in the shielding type charge eraser 17 are attracted by the negative potential of the residual charge on the photosensitive plate 4. The positive ions leak through the mesh electrode 15 and reach the front insulating layer 1 thereby neutralizing the residual charge.

When the residual charge is neutralized, the potential at the photosensitive plate 4 becomes zero, the supply of positive ions from the charge eraser 17 to the photosensitive plate 4 stops, and the photosensitive plate 4 returns to the state before charge image recording.

Thus, in the electrophotographic recording system using the shielding type charge eraser 17 according to the invention, the prior art problem ascribed to the residual charge is solved and the hysteresis effect is removed even if recording is repeated. Furthermore, according to the invention, any corona generating electric field may be used as long as such corona electric field accompanies the generation of positive ions because the corona electric field is shielded and positive ions necessary for neutralizing the residual charge are derived according to the potential of the residual charge.

In the embodiment of FIG. 4, a commercial frequency of 60 or 50 Hz is used for the corona source 18 with the result that the cost of the corona source is diminished.

Figure 5:
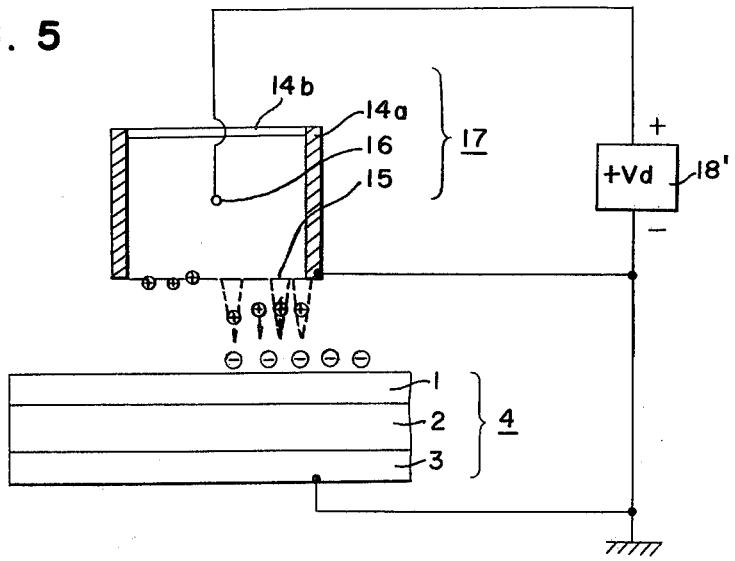
FIG. 5 is a schematic diagram showing an electrophotographic recording system using another shielding type charge eraser according to the invention.

Referring to FIG. 5, another embodiment is schematically illustrated wherein positive DC corona discharge is utilized for the corona source. This embodiment differs from the previous one in its use of a positive corona source 18'.

More specifically, the electric field of the corona wire 16 is shielded by the guard electrode 14*a*, ion transmissive guard electrode 14*b*, and mesh electrode 15. A large number of positive ions are produced in the shielding type charge eraser 17 by the positive corona source 18'. By the use of mesh electrode 15 which is constituted to meet the foregoing conditions, no corona electric field leaks out of the charge eraser 17 and positive ions escape through the mesh electrode 15 by diffusion. How positive ions escape is indicated by the dotted lines in FIG. 5. For the sake of simplicity, it is assumed that the negative charge is present only in the right side of the photosensitive plate 4 placed below the shielding type corona charger 17 and that the charge is not present on the left side thereof. As shown in FIG. 5, the mesh electrode 15 and the rear electrode 3 of the photosensitive plate 4 are at the same potential, i.e., ground potential. In this state, no electric field acts on positive ions which escape from the mesh on the left side of the photosensitive plate 4. As a result, the escaping ions are localized in the neighborhood of the mesh electrode 15 and exert no effect upon the photosensitive plate 4. On the right side where negative charge is present, an electric field owing to the negative charge is applied to the escaping positive ions to cause the positive ions to move to the photosensitive plate 4. This means that the escaping positive ions which have been localized in the vicinity of the mesh electrode 15 are liberated. This state is depicted by model on the right side of the mesh electrode 15 in FIG. 5. The positive ions which have escaped therefrom due to the negative charge potential reach the surface of the front insulating layer 1 and neutralize the residual charge on the insulating layer 1. After the charge is neutralized, the positive ions are localized again in the vicinity of the mesh electrode as in the state on the left side thereof. In other words, by the use of the charger 17, the neutralization of the charge stops when the potential viewed from the side of the mesh electrode becomes zero.

Figure 6:
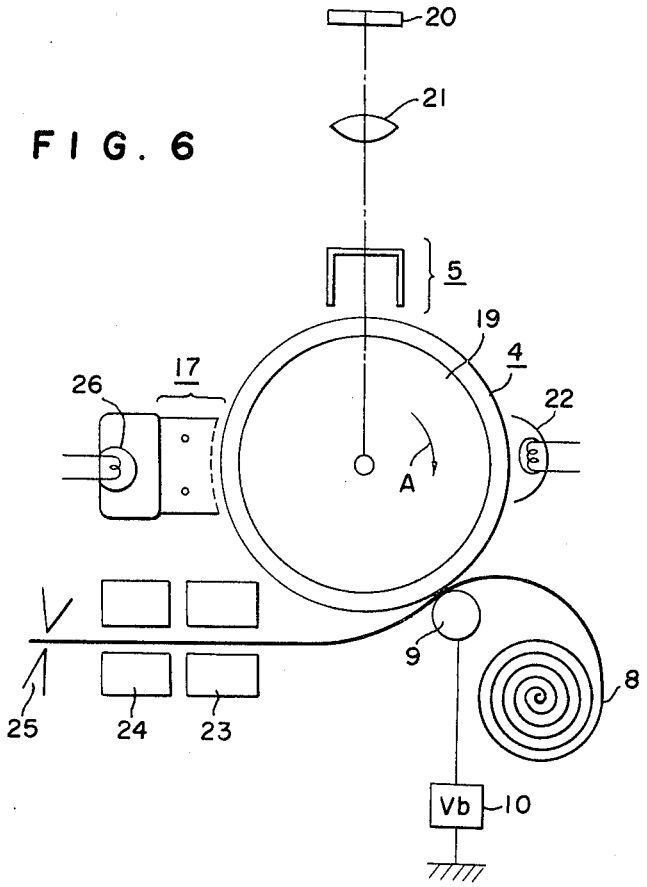
FIG. 6 is a schematic diagram showing a wet developing type electrophotographic recording apparatus associated with the system of the invention.

Another embodiment of the invention is shown in FIG. 6, wherein the invention is applied to an electrophotographic recording apparatus of a wet developing system. An electrophotographically sensitive plate 4 is disposed on a rotary drum 19 of aluminum, iron or the like, which is continuously rotated in the direction of arrow mark A.

A negative corona charger 5 is disposed near the rotary drum 19 and photosensitive plate 4. A lens system 21 and an original 20 are disposed at a given interval from each other on the axial line of the corona charger 5.

A light source 22 is installed near the photosensitive plate 4. A shielding type charge eraser 17 and an exposure lamp 26 are disposed substantially on the axial line of the light source 22.

In FIG. 6, the numeral 9 denotes a transferring roller, 10 a transferring roller bias source, 8 electrostatic recording paper, 23 a developing part, 24 a fixing part, and 25 a cutter. The recording paper 8 is transported in contact with the photosensitive plate 4 and the transferring roller 9, passed through the developing part 23 and the fixing part 24, and then cut by the cutter 25.

The charge image is recorded in the following manner. The image light reflected from or transmitted through the original 20 is projected on the negative corona charger 5 by way of the lens system 21. The corona charger 5 is of the construction with its top optically opened so that both exposure and charging are available from the side of its top. There are no limitations on the negative corona charger 5 with respect to the general concept of negative corona charges conceivable in the prior art.

A charge image is formed on the photosensitive plate 4 in the position under the negative corona charger 5 by the simultaneous exposure and charging method described with reference to FIG. 1. At the position of transferring roller 9, the charge image is transferred to the electrostatic recording paper 8 under the application of a transferring bias voltage V*b* supplied from the transferring bias source 10. In this step, the transferring bias voltage is not essential and may be grounded. The charge image transferred to the recording paper 8 is toner-developed in the developing part 23, subjected to heat in the fixing part 24, and the recording paper is cut to a suitable length by the cutter 25. Thus a cycle of the recording process is completed.

After the charge image transfer, the photosensitive plate 4 holding the residual charge is rotated in the arrow-marked direction to the position under the shielding type charge eraser 17. As previously described, the charge eraser 17 is capable of neutralizing the surface potential of the photosensitive plate 4 by the air of the residual charge on the photosensitive plate.

To effectively erase the residual charge on the front insulating layer 1, the photoconductive sensitive layer 2 must be of low resistance to allow the presence of as many carriers as possible. For this purpose, light is applied to the photosensitive plate 4 from the exposure lamp 26 by means of the charge eraser 17 through the mesh electrode.

The aim of this exposure is to accelerate the neutralization of the charge on the photosensitive plate 4 and is not to form a polarization state of reverse polarity as in the inverted electric field method in the prior art.

This exposure step is not needed when the resistance of the photoconductive sensitive layer is relatively low because the velocity of charge neutralization depends upon the quantity of positive ions moved by the force of residual charge present on the photosensitive plate 4.

Figure 7:
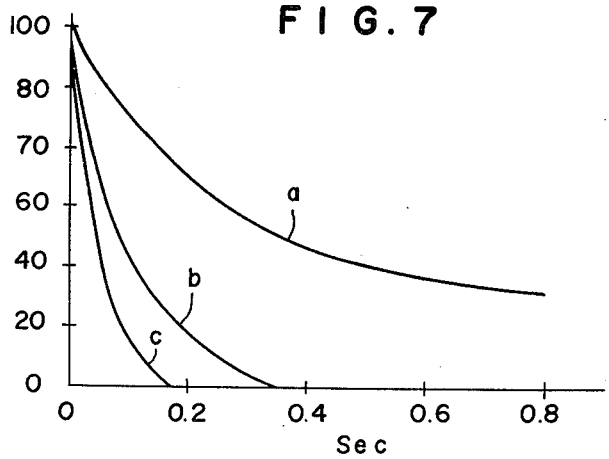
FIG. 7 is a graphic diagram showing the relationship between the charge erasing velocity and the exposure intensity of the electrophotographic sensitive plate in the system of the invention using shielding type charge erasers.

FIG. 7 shows a typical example of the relationship between the charge erasing velocity and the dose of light applied. In FIG. 7, the curve *a* represents the relationship measured with no light applied, the curve *b* the relationship measured with light applied at 10 lux·sec, and the curve *c* the relationship measured at 500 lux·sec, under the condition that the AC corona voltage is 5.0 kV, and the gap between the mesh electrode 15 and the photosensitive plate 4 is 2 mm. The charge erasing velocity largely depends on the construction and operating condition of the shielding type corona charge eraser 17. Experimentally, the illuminance needed was greater than 25 lux in order to erase the residual charge in 0.4 sec.

The curve c is obtained at a sufficiently high illuminance, that is, 500 lux, where the greatest erasing velocity is attained. This erasing velocity is about 0.2 seconds which depends on the quantity of positive ions produced in the shielding type charge eraser as well as on the gap between the photosensitive plate 4 and the mesh electrode 15 and on the capacitance (pf/cm$^2$) of the front insulating layer 1.

According to the invention, the residual charge is neutralized or erased by the charge eraser 17 by utilizing the potential of the residual charge itself. An external electric field needed to form a charge image on the photosensitive plate 4 is limited to the negative charger 5. This makes it possible to reduce the number of charging steps in comparison with that needed in the prior art, and to thereby minimize damage on the photosensitive plate due to corona charging.

The photosensitive plate from which the residual charge is removed by positive corona produced when a positive corona voltage, +V*d*, is applied from the positive corona source to the corona wire 16 of the shielding type charge eraser 17 is further rotated to the position of negative corona charger 5 wherein another charge image is recorded on the photosensitive plate free of the influence of the residual charge.

The light source 22, i.e., a uniform exposure lamp, may be installed before the step of image transfer as shown in FIG. 6. It is to be understood that the embodiment illustrated in FIG. 6 is but one arrangement according to the invention and a variety of modifications may be made to the disclosure arrangement. Several specific examples of these modifications will be described below.

As previously described, one of the more important constituent elements of the system of the invention is the shielding type charge eraser 17 which must satisfy the following conditions:

a. The corona electric field must be effectively shielded from the photosensitive plate 4.

b. Only ions can be supplied to the photosensitive plate 4.

Thus, many modifications may be made of the disclosed construction as long as these conditions are met. One example of modifications will be described by referring to FIG. 8.

Figure 8:
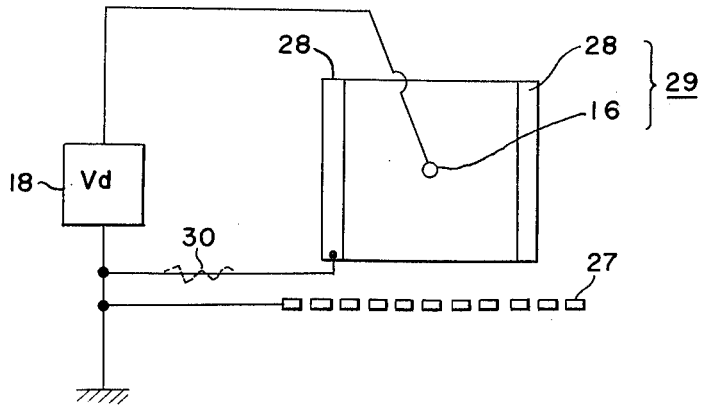
FIG. 8 is a schematic diagram showing another electrophotographic recording system of the invention using shielding type charge erasers.

In FIG. 8, a corona wire 16 is disposed between a pair of grounding electrodes 28, and a corona charger 29 is constituted of the corona wire 16 and the grounding electrodes 28. A number of porous shielding plates 27 of mesh or like construction capable of shielding the AC corona electric field of the corona charger 29 and permitting ions to be transmitted therethrough are disposed at regular intervals facing one end of the pair of grounding electrodes. The shielding plates 27 are grounded at one side and thus are able to serve as the shielding type charge eraser 17 as in the embodiment described in reference to FIG. 6. In the foregoing embodiments, commercial AC power is used with the aim to save the cost of a separate power source. It is apparent that the invention is not limited to this example but any power source of alternating waveform may be used. For example, an AC sine-wave power source of several kilohertz to several tens kilohertz may be used to maintain a stable corona discharge in the shielding type charge eraser 17. Instead of a sine-wave power source, a square-wave or sawtooth-wave power source may be used.

Furthermore, for example, a positive DC voltage may be superposed on AC power. This makes it feasible to derive positive ions from the charge eraser with higher efficiency.

When DC corona discharge is employed, a bias resistor 30 indicated by a dotted line is installed as shown in FIG. 8 to enable the pair of grounding electrodes 28 to be at a potential slightly on the positive side with respect to the shielding plates 27. With this arrangement, the density of ions moving toward the shielding plates 27 can be increased and thus the neutralization of the residual charge can be accelerated.

In the foregoing embodiments, the mesh electrode and the shielding electrode are kept at ground potential. According to the invention, "ground potential" is taken to be the potential of the photosensitive plate 4. To this effect, therefore, a voltage may be applied so as to make the potential at the photosensitive plate 4 identical to that at the mesh electrode and the shielding electrode.

In the embodiments described above, the photoconductive layer is formed of the mixture of CdS powder and 10 st% organic resin binder. If a Se or Se-Te alloy vapor-deposition layer which exhibits p-type conductivity is used instead, the polarity of the corona voltage as in the embodiments must be reversed.

Instead of CdS powder, other photoconductive materials may be used; such as, for example, CdSe, CdSx, $Se_{1-x}$, ZnS, wt % $xZn_{1-x}S$, ZnO, PbO, polyvinylcarbazole, and Se-polyvinylcarbazole compound.

In the embodiments disclosed above, only the system in which the charge image transferred to the electrostatic recording paper is developed in a liquid developer is shown. Other systems may be employed instead of this wet developing system; for example, the dry type developing system may be used wherein a bias voltage is applied to the developer magnetic brush to make the developing level adjustable.

The original to be recorded includes books, as well as an optical image displayed in terms of a flying spot. The invention may also be utilized with facsimile and electronic printers.

Although specific embodiments of the invention have been disclosed herein in detail, it is to be understood that this is for the purpose of illustrating the invention and should not be construed as necessarily limiting the scope of the invention.

What is claimed as new and desired to be secured by Letters Patent of the United States is:

1. An electrophotographic recording system comprising
   means for forming a charge image of specific polarity on an electrophotographically sensitive plate,
   means for transferring the charge image to a recording paper, and
   means for neutralizing the residual charge on the electrophotographically sensitive plate comprising a shielding type charge eraser comprising
   means for generating a corona discharge producing an electric field and a large number of ions,
   means for shielding the electric field from the residual charge and permitting only ions of a polarity opposite to the residual charge to be disposed adjacent to the electrophotographically sensitive plate, the ions of a polarity opposite to the residual charge being attracted by the residual charge to neutralize the residual charge.

2. An electrophotographic recording system as claimed in claim 1 wherein the shielding type charger eraser is disposed to face the electrophotographically sensitive plate and is operated to generate an AC corona discharge.

3. An electrophotographic recording system as claimed in claim 1 wherein the shielding type charge eraser is disposed to face the electrophotographically sensitive plate and is operated to generate a DC corona discharge of opposite polarity to that of the residual charge.

4. An electrophotographic recording system as claimed in claim 1 wherein the electrophotographically sensitive plate consists of at least three layers; a front insulating layer, a photoconductive sensitive layer, and a rear electroconductive layer.

5. An electrophotographic recording system as claimed in claim 4 further comprising means for applying light to the photoconductive sensitive layer while neutralizing the residual charge.

6. An electrophotographic recording system as claimed in claim 4 wherein the shielding type charge eraser comprises a top transparent guard electrode, side guard electrodes, a bottom mesh electrode, a corona wire disposed between the electrodes, and a corona source to generate a voltage between the guard electrodes and the corona wire.

7. An electrophotographic recording system as claimed in claim 4 wherein the shielding type charge eraser comprises a corona wire and a pair of grounding electrodes, shielding plates disposed at regular intervals facing the grounding electrodes, and a corona source to apply a voltage between the grounding electrodes and the corona wire.

8. An electrophotographic recording system as claimed in claim 7 wherein the shielding plates are of porous material and are maintained at ground potential.

9. An electrophotographic recording system as claimed in claim 7 further comprising a resistor connected between the corona source and a grounding electrode.

* * * * *